US005704599A

United States Patent [19]

Slothower

[11] Patent Number: 5,704,599

[45] Date of Patent: Jan. 6, 1998

[54] VACUUM APPARATUS FOR ALIGNING AND SECURELY POSITIONING COMPONENTS

[76] Inventor: Stephen G. Slothower, 1921 Palomino Rd., Dover, Pa. 17315

[21] Appl. No.: 588,303

[22] Filed: Jan. 18, 1996

[51] Int. Cl.[6] ..... B25B 11/00

[52] U.S. Cl. ..... 269/21; 269/41; 269/88; 269/66

[58] Field of Search ..... 269/21, 41, 88, 269/258, 152, 153, 155, 45, 194; 294/64.1, 65

[56] References Cited

U.S. PATENT DOCUMENTS

| | | | |
|---|---|---|---|
| 2,660,141 | 11/1953 | Thomas . | |
| 3,167,326 | 1/1965 | Heessels | 269/21 |
| 3,174,188 | 3/1965 | Wood . | |
| 3,394,389 | 7/1968 | Amir | 269/155 |
| 3,831,991 | 8/1974 | Lukeman | 294/64.1 |
| 4,021,516 | 5/1977 | Stevenson . | |
| 4,236,703 | 12/1980 | Stevenson . | |
| 4,703,966 | 11/1987 | Lewecke et al. | 294/65 |
| 4,708,381 | 11/1987 | Lundback | 269/21 |
| 4,936,053 | 6/1990 | Shanelec | 269/45 |
| 5,042,772 | 8/1991 | Madjeski | 269/21 |
| 5,129,636 | 7/1992 | Bridgstock | 269/45 |
| 5,135,206 | 8/1992 | Martinez . | |

FOREIGN PATENT DOCUMENTS 276097 10/1913 Germany .

*Primary Examiner*—Timothy V. Eley
*Assistant Examiner*—Lee Wilson
*Attorney, Agent, or Firm*—Sixbey, Friedman, Leedom & Ferguson, P.C.; Charles M. Leedom, Jr.; Tim L. Brackett, Jr.

[57] ABSTRACT

An apparatus is provided for aligning and securely positioning at least two components relative to each other, comprising a support frame, first and second alignment plates pivotally mounted on the support frame for abutment by the components to permit positioning of the components of various angles relative to each other, and a vacuum device for holding a component against the respective plate. The vacuum device may include first and second flexible vacuum pads corresponding to the plates, a respective vacuum pump associated with each alignment plate and a control valve for selectively controlling the flow of supply air to the vacuum pumps. A locking device may be provided for preventing relative pivotal movement of the plates by securing the plates in a predetermined alignment position. The alignment and securing apparatus of the present invention can be used to easily, quickly and securely position two components in a variety of relative orientations. Also, the vacuum assembly is designed to create a highly compact, unitized aligning and securing apparatus capable of generating extremely high holding forces to prevent relative movement of the components.

17 Claims, 4 Drawing Sheets

VACUUM APPARATUS FOR ALIGNING AND SECURELY POSITIONING COMPONENTS

TECHNICAL FIELD

This invention relates to an apparatus for aligning, positioning and maintaining alignment of articles during a treating or joining process.

BACKGROUND OF THE INVENTION

During many construction, fabrication and assembly procedures, components of a structure must be aligned, and held in alignment, to ensure the proper connection and final orientation of the parts. For example, U.S. Pat. Nos. 4,021,516 and 4,236,703 to Stevenson disclose clamping devices for holding frame members together to facilitate joining the members by, for example, adhesive. These devices include holding teeth or pins which engage the frame members by penetrating the frame material, i.e. wood. The devices also include cradle surfaces for supporting the frames at a right angle to one another. However, the teeth of these devices can not adequately grip the surface of a member formed of a hard material such as metal. Also, the clamping devices of Stevenson are incapable of clamping one edge of a plate to the flat, intermediate portion of another plate.

Accurate alignment and stable positioning of the components during connection of the components is especially critical when the connecting or joining process creates an essentially permanent connection, such as by welding, brazing, soldering or riveting. Once a permanent joining process is complete, separation of the components to correct an alignment error often either damages the components preventing their use without costly reconditioning, or renders the component(s) completely useless for the particular application. Often, prior to joining the components, at least one edge of a component must be aligned with a portion of another component while holding the plates at a predetermined angle relative to one another. For example, U.S. Pat. No. 2,660,141 to Thomas discloses a welding vise including clamping jaws capable of handling metal plates of various sizes. German Patent No. 276097 appears to disclose a similar clamping device. However, these devices must be positioned close to one edge of a component to permit the clamping jaws to extend around the edge of the respective component or plate to clamp the plate between the jaws. Consequently, these clamps are less versatile and incapable of securely grasping the intermediate planar area of a component to securely position the edge of another component adjacent the area. Also, the set-up and alignment adjustment procedure required by using these devices has been found to be unduly time consuming.

U.S. Pat. No. 3,174,188 to Wood discloses a mold device for enabling components of a structure to be bonded together in a factory or on a job site. The mold includes a V-shaped channel having two integral flat surfaces positioned perpendicular to one another. Each surface includes a vacuum groove connected to a vacuum source via holes formed in the surfaces and an O-ring positioned in a groove encircling the vacuum groove. The components to be joined are positioned against the mold surfaces and a vacuum created to hold the members against the mold. This reference suggests that the angle between the mold surfaces could be varied in order to create different types of joints. However, the mold surfaces disclosed in Wood are rigidly fixed at the predetermined angle. Therefore, a single mold designed in accordance with Wood does not permit components to be easily and effectively aligned and secured at a variety of angles. Based on the teachings of Wood, a different mold would be required for each angled orientation desired. Also, the O-ring used to create the seal between the mold surface and the member is likely to be incapable of creating an effective seal against many surfaces. In addition, the Wood mold and vacuum attachment is designed to occupy the V-shaped space between two components positioned to form a 90 degree angle while permitting treatment of the opposite, outer surfaces of the components. Therefore, the Wood device undesirably obstructs, and practically prevents, any treatment of the inner surfaces or edges of the components, such as bonding by welding or gluing.

U.S. Pat. No. 5,135,206 is noted for disclosing a damping device for retaining a piece of a counter in place against vertical and horizontal countertop portions. Suction cups are used to secure the clamp in place to resist the force of a spring biased bolt which applies a retaining force to the counter piece. However, this device is not used to support, position or align components to be joined. Also, the cups are not surrounded by planar support surfaces and therefore could not function to reliably and accurately align and position components to be joined. Moreover, the vacuum in each cup is created by the collapsing action of the cup itself resulting in a relatively weak gripping force incapable of resisting relative movement of the countertop portions.

Consequently, there is a need for a versatile alignment apparatus for assisting in reliably and accurately aligning and maintaining alignment of articles or structures to be processed in some manner.

SUMMARY OF THE INVENTION

It is an object of the present invention, therefore, to overcome the disadvantages of the prior art and to provide an apparatus for aligning and securely positioning two components relative to one another which is simple and easy to use yet exceptionally effective.

It is another object of the present invention to provide an alignment and securing apparatus for securing the components against relative movement while the components are connected or joined by, for example, welding.

It is yet another object of the present invention to provide an alignment and securing apparatus which is easily transportable and lightweight.

It is a further object of the present invention to provide a securing apparatus which minimizes the time required to securely position two components relative to one another to effectively prevent relative movement.

It is a still further object of the present invention to provide an alignment and securing apparatus which avoids the need to engage the edge of the component or plate being secured.

Still another object of the present invention is to provide an alignment and securing apparatus capable of properly aligning and positioning two components in a variety of angular orientations.

These and other objects are achieved by providing an apparatus for securely positioning at least two components relative to each other, comprising a support frame, a plurality of alignment plates including first and second plates mounted on the support frame for abutment by the components and a pivot device connected to at least one of the plates for permitting pivotal movement of the plate to allow positioning of the components of various angles relative to each other. The apparatus also includes a vacuum device connected to at least one of the plates while holding a component against the respective plate. The plates may be mounted so as to be capable of being positioned in a single common plane. The pivot device may include a pivot hinge connected to the alignment plates to permit pivotal movement of both plates around a common pivot axis. Each plate may be capable of pivoting at least approximately 90° around the common pivot axis. The plates may include an abutment surface for abutting a respective component while the vacuum device may include a first and second flexible vacuum pads corresponding to the plates. The vacuum device may also include a vacuum pump mounted on some portion of the apparatus. The vacuum pump may include a first vacuum pump mounted on the first alignment plate, a second vacuum pump mounted on a second alignment plate and an air supply for supplying pressurized air to the vacuum pumps. The vacuum pump may further include a control valve mounted on the support frame for controlling the flow of supply air to the vacuum pumps. A locking means may be provided for preventing relative pivotal movement of the plates by securing the plates in a predetermined alignment position. Also, the support frame may include a first pair of elongated support arms pivotally connected at respective first ends to the first plate and the second pair of elongated support arms pivotally connected to the second plate. Each support arm of the first pair of arms may be pivotally connected at a second end to one support arm of the second pair of support arms. The plates may include alignment rails extending outwardly from the first side of the plates to form an abutment surface for abutment by a component. The vacuum pads may be mounted on the first side of the plates between the alignment rails.

DETAILED DESCRIPTION OF THE PREFERRED EMBODIMENT

Figure 1:
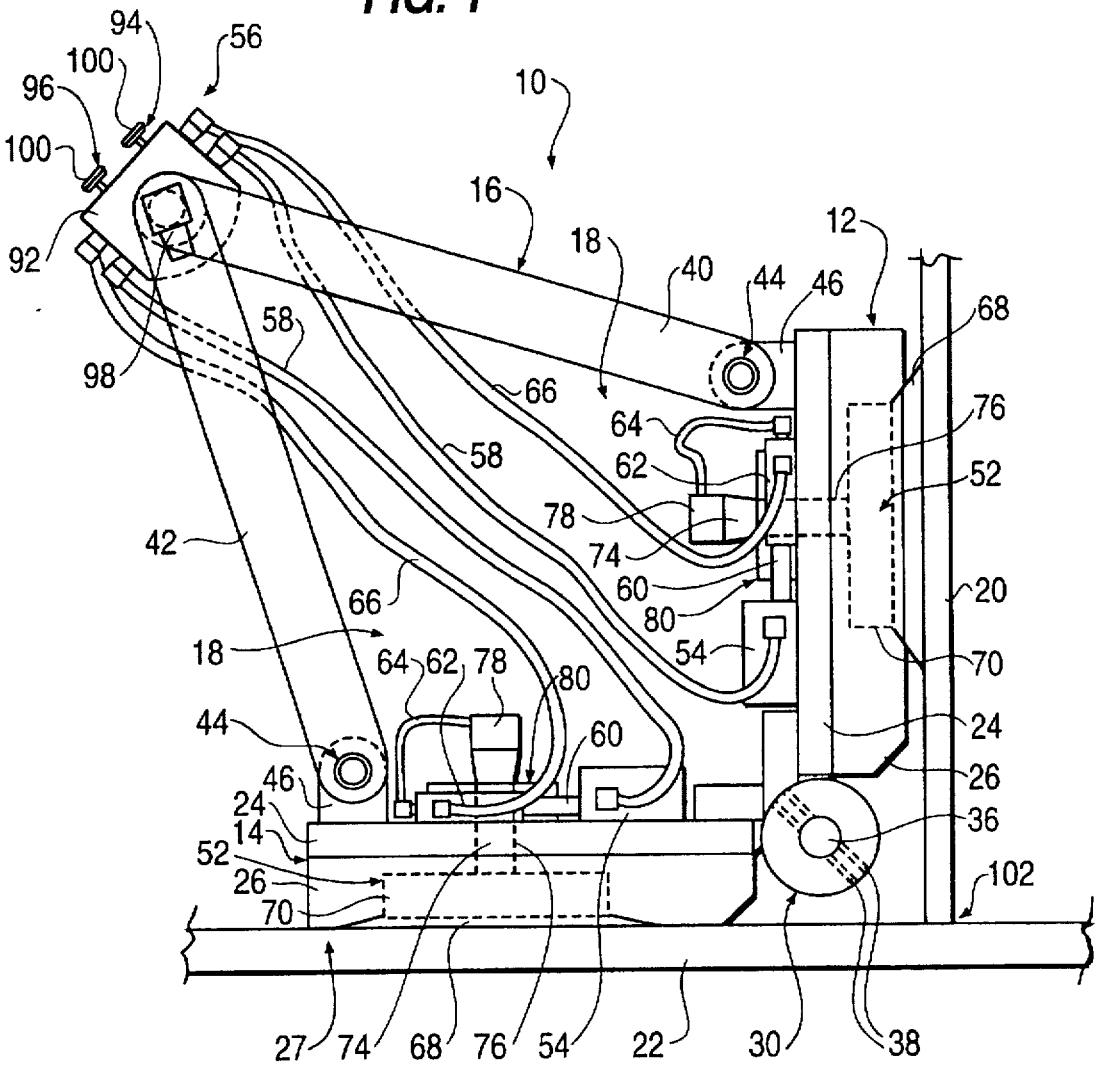
FIG. 1 is a side detailed view of the aligning and securing apparatus of the present invention in an extended position for gripping the inner surfaces of two components.
Figure 3:
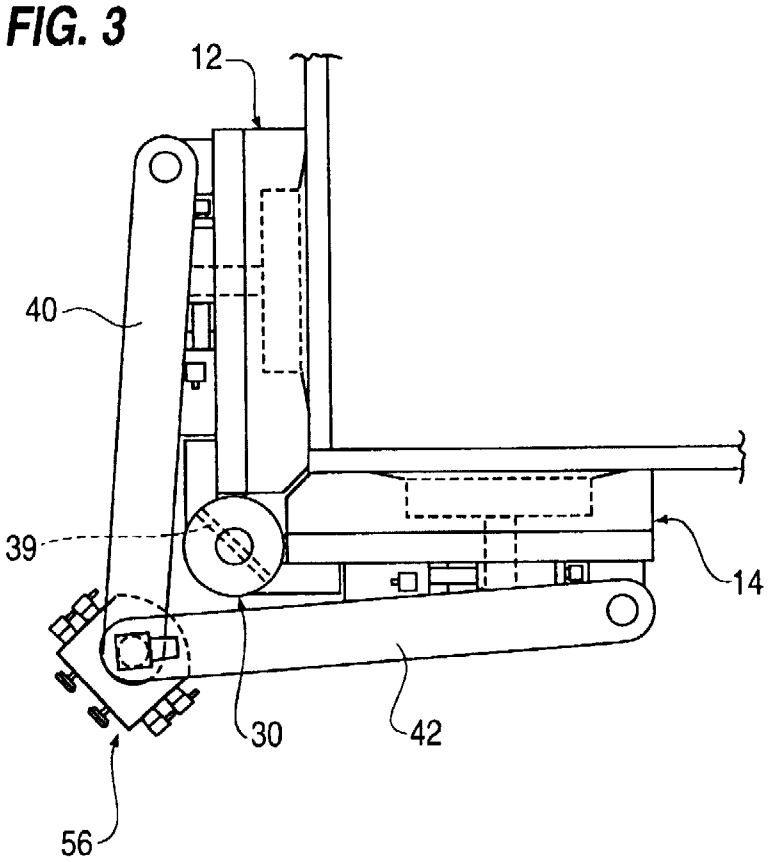
FIG. 3 is a side detailed view of the aligning and securing apparatus of the present invention in a retracted position for gripping the outer surfaces of two components.
Figure 2:
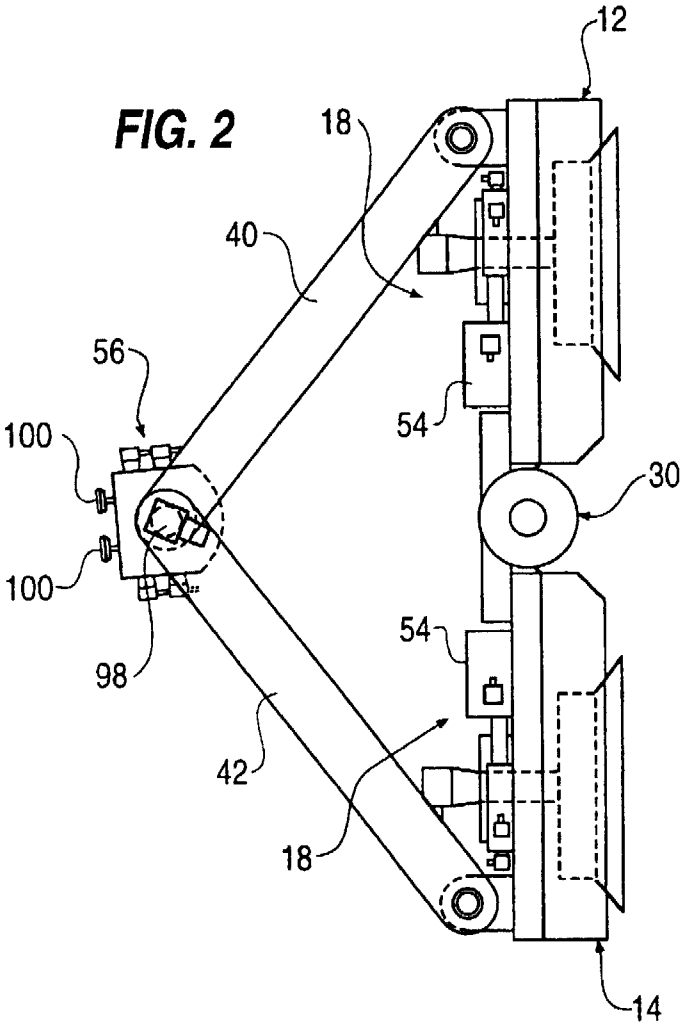
FIG. 2 is a side detailed view of the aligning and securing apparatus of the present invention in a planar position for gripping two components positioned in a single plane.

Referring to FIGS. 1, 2 and 3, the alignment and securing apparatus of the present invention indicated generally at 10 includes first and second alignment plates 12 and 14, a support frame 16 for supporting plates 12, 14 and a vacuum assembly 18 for gripping and holding components 20 and 22 securely against plates 12 and 14, respectively. The alignment and securing apparatus 10 is used to align and securely position components 20, 22 relative to each other to permit the components to be connected or joined along a predetermined connection location or joint so as to result in a connected structure having a desired orientation. Alignment and securing apparatus 10 greatly reduces the time and effort required to securely position components 20 and 22 relative to one another while creating a significantly large securing force capable of maintaining alignment of components 20, 22. Components 20, 22 .may be any articles or structures formed of essentially any material generally impervious to air.

Figure 5:
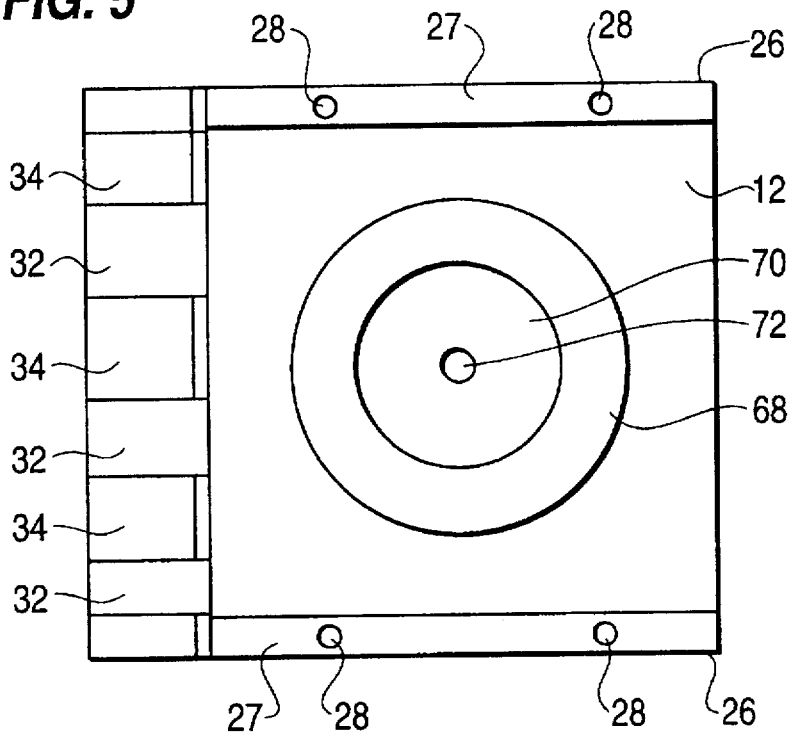
FIG. 5 is a front view of one of the alignment plates of the apparatus of the present invention showing the vacuum pad.

Each of the first and second alignment plates 12 and 14 include a generally rectangularly shaped base portion 24 and a pair of alignment rails 26, 28 extending along opposite sides of base portion 24. Alignment rails 26 are connected to base portion 24 by threaded fasteners extending through complimentary apertures 28 formed in base portion 24 and rails 26. As shown in FIG. 5., each alignment rail 26 includes an abutment surface 27 for abutting and aligning a component. Abutment surfaces 27 are preferably flat and positioned in a single plane for abutting a generally flat or only slightly curved surface of a component such as a plate. However, alignment surfaces 27 could be shaped to correspond to the shape of a non-planar component, such as a pipe. First and second alignment plates 12 and 14 and alignment rails 26 may be formed of any metal, plastic or other material having sufficient rigidity and durability.

Preferably, first and second alignment plates 12 and 14 are pivotally connected along adjacent respective edges by a pivot hinge 30. As shown in FIG. 5, pivot hinge 30 includes hinge extensions 32 connected to or integrally formed with first positioning plate 12 and hinge extensions 34 connected to integrally formed with second alignment plate 14. Each hinge extension 32, 34 forms a cylindrical aperture which aligns with the cylindrical aperture of an adjacent hinge. In this manner, hinge extensions 32, 34 are engagingly positioned to align the cylindrical apertures to create an aperture for receiving a hinge pin 36. Hinge pin 36 may be secured in the aperture in any conventional manner, such as by a roll pin 39 extending through an aperture formed in one of the hinge extensions and pin 36. Thus, pivot hinge 30 forms a common pivot axis about which first and second alignment plates 12 and 14 may be pivoted or rotated into a predetermined orientation or alignment position. As shown in FIG. 1, alignment plates 12 and 14 may be locked into a specific angular orientation using four set screws 38 positioned in apertures formed in hinge extensions 32 and/or 34. The set screws are tightened into abutment with hinge pin 36 to prevent movement of the plates.

Figure 4:
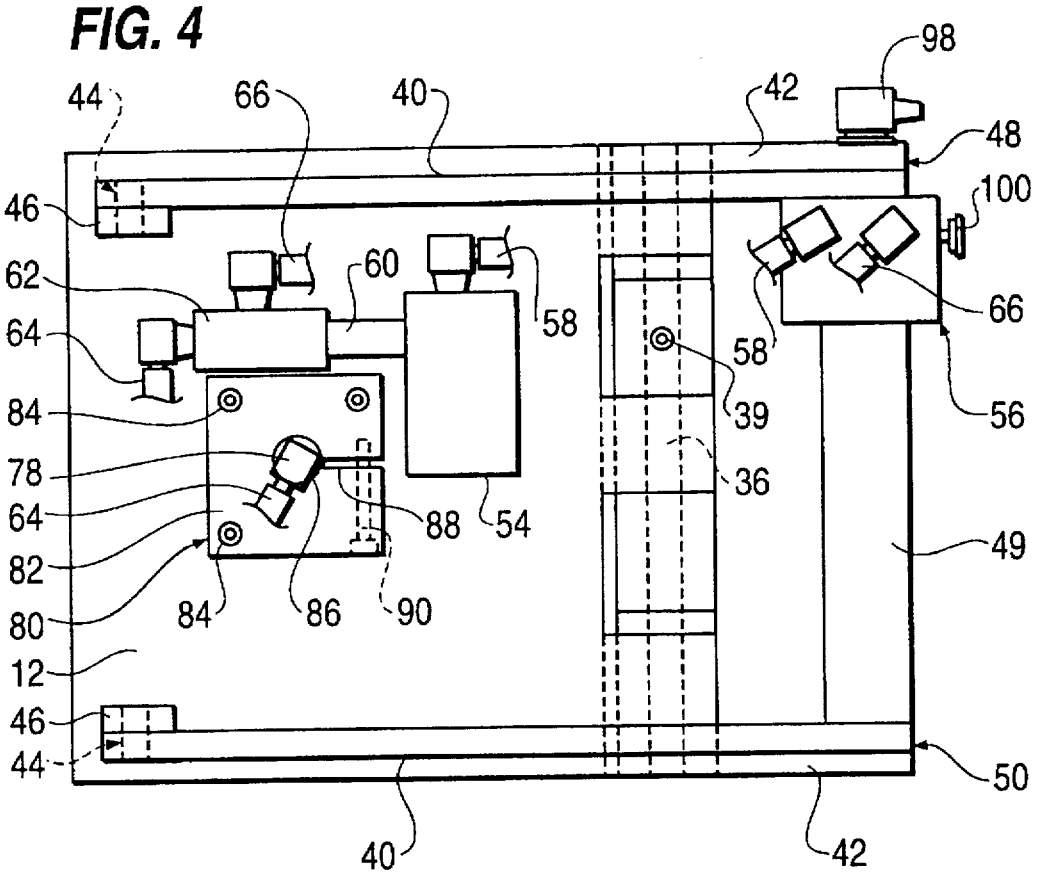
FIG. 4 is a rear view of the aligning and securing apparatus of FIG. 3 showing various features of the vacuum assembly.

As shown in FIGS. 1 and 4, support frame 16 includes a first pair of support arms 40 pivotally connected to alignment plate 12 and a second pair of support arms 42 connected to alignment plate 14. Each support arm of first and second pairs of support arms 40, 42 is connected to the respective plate by a pin connection 44 including a mounting brackett 46 extending from the back surface of the respective plate at the outer end of the plate opposite pivot hinge 30. An outer end of each of the first pair of support arms 40 pivotally connects with an outer end of one of the second pair of support arms to form pivot connections 48 and 50 as shown in FIG. 4. Pivot connections 48 and 50 may be formed on a cross bar 49 extending between the connections to provide support for support arms 40, 42. In this manner, support frame 16 connects the outer ends of first and second alignment plates 12 and 14 so as to provide support for the plates while permitting the plates to be smoothly and easily pivotally rotated around the common pivot axis formed by pivot hinge 30. Pivotal movement of one plate causes corresponding simultaneous movement of the other plate in the opposite direction around the common pivot axis. Pivot hinge 30 and pivotable support flames 16 thus permit first and second alignment plates 12 and 14 to be moved into a variety of angular orientations, three of which are shown in FIGS. 1–3 and discussed hereinbelow.

Figure 6A:
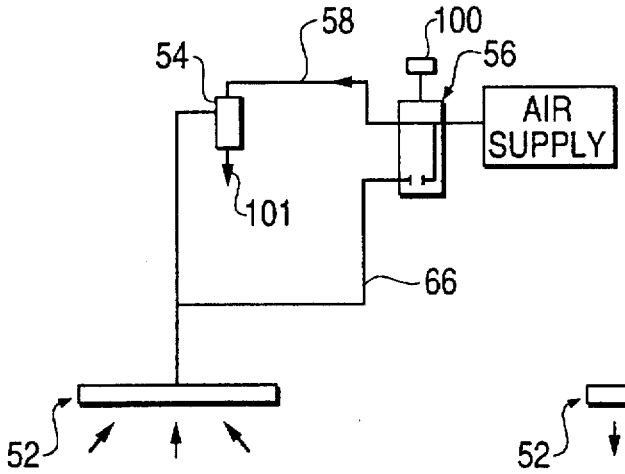
FIG. 6A is a schematic view of the vacuum assembly used with the aligning and securing apparatus of the present invention with the control valve in the vacuum-on position.
Figure 6B:
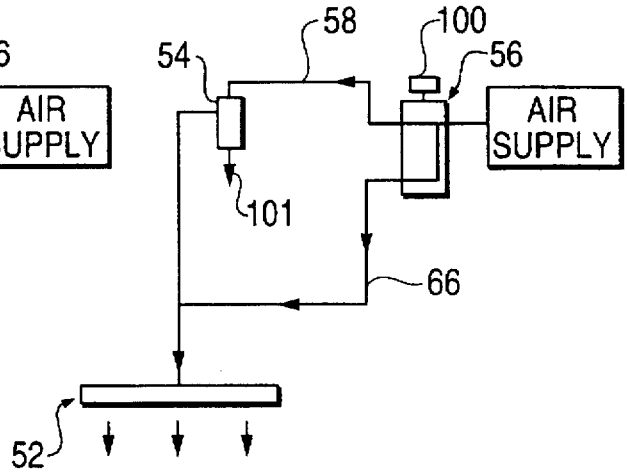
FIG. 6B is a schematic view of the vacuum assembly with the control valve in the vacuum-off position.
Figure 7A:
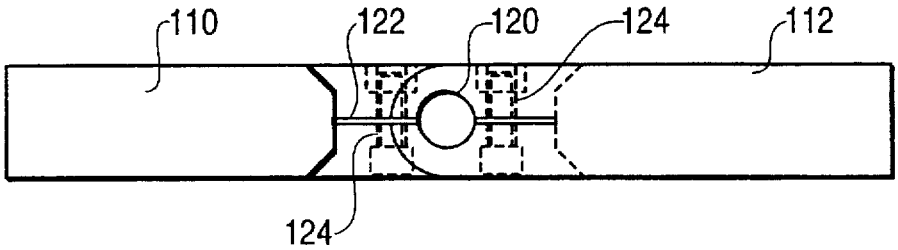
FIG. 7A is a side view of an alternative embodiment of a hinged alignment plate assembly having identical alignment plates.
Figure 7B:
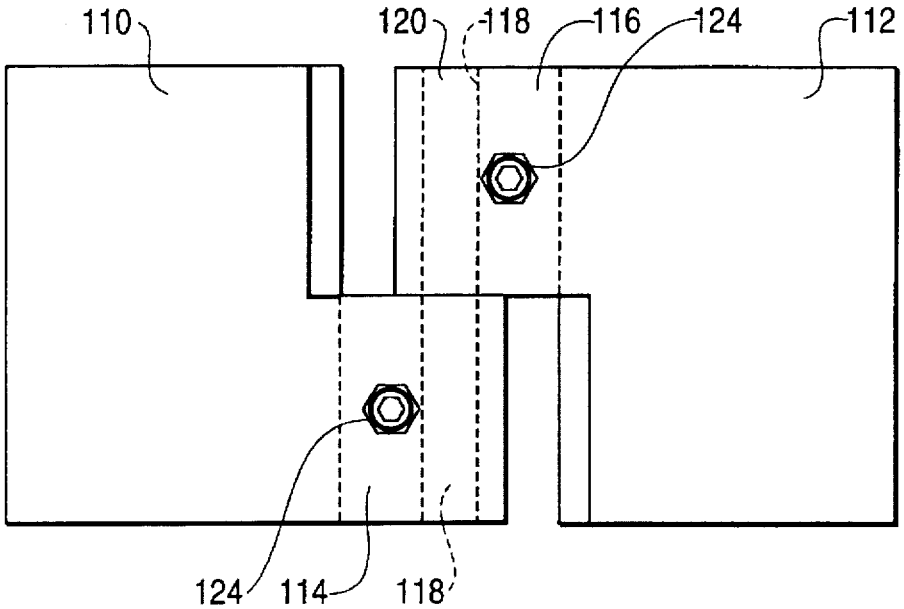
FIG. 7B is a front view of the plate assembly of FIG. 7A.

Referring to FIGS. 1 and 4, vacuum assembly 18 includes a vacuum pad assembly 52 mounted on each alignment plate 12, 14, a vacuum pump 54 associated with each vacuum pad assembly 52 and a control valve assembly 56. Generally, control valve assembly 56 can be selectively operated to control the vacuum produced by a respective vacuum pump 54 between a respective vacuum pad 52 and the component to be secured against the respective plate. The vacuum assembly associated with each alignment plate is identical in structure and operation and therefore one vacuum assembly will be described hereinbelow. Vacuum pump 54 is mounted on the rear side of the respective alignment plate for receiving pressurized air from control valve assembly 56 via an air supply hose 58. Vacuum pump 54 is preferably a venturi-type vacuum pump such as pump model number 093H supplied by Air-Vac, Inc. Vacuum pump 54 is connected to vacuum pad assembly 52 via a pipe fitting 60, a three-way fitting 62 and a connector hose 64. In this manner, pressurized air flowing through vacuum pump 54 and exiting to the atmosphere at 101 (FIGS. 6A and 6B) draws air from vacuum pad assembly 52 through hose 64, three-way fitting 62 and pipe fitting 60 creating a vacuum in vacuum pad assembly 52. A bypass hose 66 connects control valve assembly 56 to three-way fitting 62 to provide a supply of pressurized air to vacuum pad assembly 52 to release the vacuum and vacuum pad assembly 52 when disengagement of a component from an alignment plate is desired, as described more fully hereinbelow.

The vacuum pad assembly 52 includes a flexible vacuum pad formed of any flexible material, such as rubber, capable of sealingly engaging a surface of a component to be secured. Preferably, vacuum pad 68 is generally conical shaped for sealingly abutting a generally flat or only slightly curved surface of a component. However, vacuum pad 68 may be formed with another shape, e.g. semi-cylindrical, to permit sealing abutment by a complementary shaped component, e.g. a pipe. Vacuum pad 68 is formed on a supporting disc 70 by, for example, a molding process. Disc 70 includes a central aperture 72 for delivering air to and drawing air from vacuum pad 68. A suction pipe 74 extends through an axis port 76 formed in base portion 24 of the respective alignment plate and into aperture 72 to threadably engage disc 70 at one end. Connector hose 64 is connected to the opposite end of suction pipe 74 via a suction fitting 78. The vacuum pad assembly is secured to the respective alignment plate by a pad mounting device 80 as shown in FIG. 4. Pad mounting device 80 includes a plate 82 fastened to the rear surface of the respective plate by three fasteners 84. Plate 82 includes a central port 86 through which suction pipe 74 extends. Plate 82 also includes a cut-out 88 extending radially outward from central port 86 to one side of plate 82. One corner of plate 82 is not fastened to a respective alignment plate but includes an aperture extending along the plane of plate 82 on both sides of cut-out 88. A fastener extends through aperture 90 and cut out 88 so that tightening of the fastener pulls the unfastened portion of plate 82 to move the portion of plate 82 defining central port 86 into secure abutment against suction pipe 74. In this manner, vacuum pad assembly 52 can be adjustably secured relative to abutment surface 27 of the respective plate. Vacuum pad assembly 52 should be secured so that the outer edge of vacuum pad 68 extends just beyond the plane extending through abutment surfaces 27 of alignment rails 26. In this manner, the pads can be easily adjusted to create an optimum seal against the component while achieving the necessary holding force. The vacuum pad 68 and supporting disc 70 may be of the model number VC27 supplied by VI-CAS, Inc.

Control valve assembly 56 includes a valve body 92 mounted on cross bar 49, a first air flow valve 94 for controlling vacuum assembly 18 associated with first alignment plate 12 and a second air flow valve 96 for controlling air flow to the vacuum assembly associated with second alignment plate 14. Air flow valves 94, 96 each include a valve plunger (not shown) mounted in a respective cavity formed in valve body 92. For example, the air flow valves may be model number MAV-2C manufactured by Clippard Mininatics. Each valve cavity is connected to an air supply port formed in valve body 92 which connects with an air supply source via an air supply fitting 98 connected to one end of cross bar 49. Each air flow valve 94, 96 includes a control button 100 biased in an outward position so as to position the valve plunger to uncover the respective air supply port to allow air to flow through air hose 58 to vacuum pump 54 while blocking flow through bypass hose 66 thereby creating a vacuum at vacuum pad 68. The air flow valves 94, 96 are also designed so that when button 100 is pushed, at least a portion of the supply air is diverted to the bypass hose 66 thereby supplying pressurized air to vacuum pad 68 to terminate the vacuum and release the component.

As can be seen from FIGS. 1, 2 and 3, the alignment and securing apparatus of the present invention can be moved into a variety of orientations so that first and second alignment plates 12 and 14 are positioned at various angles relative to one another. As a result, alignment and securing apparatus 10 of the present invention is capable of connecting components in a variety of desired configurations. For example, as shown in FIG. 1, the apparatus may be positioned in an extended position with the abutment surfaces 27 of alignment plates 12 and 14 positioned perpendicular to one another and are arranged to face outwardly from one another. As a result, a 270° angle exists between the abutment surfaces. This position permits the alignment and securing apparatus to be connected anywhere along the flat surface of component 22 and to align and secure component 20 perpendicular to component 22. Thus, in this orientation, components 20 and 22 can be connected at an abutting joint, indicated at 102, by, for example, welding, soldering, brazing, riveting or any other type of joining process. As shown in FIG. 2, first and second alignment plates 12 and 14 may be pivoted and locked in place so that the abutment surfaces of the plates are coplanar. This orientation permits the ends or edges of two components to be positioned in abutment and secured against relative movement during a joining process. The alignment and securing apparatus 10 may also be moved into a retracted position for aligning two components to form a corner structure as shown in FIG. 3. In this manner, the apparatus securely grasps the outer surfaces of the corner components allowing the inner corner joint to be worked without obstruction or interference by the apparatus.

During use, for example, as shown in FIG. 1, first and second alignment plates 12 and 14 are moved into a desired orientation and locked into position using set screws 38 and/or a role pin. An air supply hose is then connected to air supply fitting 98. At this point, air flow control valves 94, 96 are positioned to allow air flow to vacuum pump 94 which draws air into vacuum pad 74. Vacuum pad 68 of second alignment plate 14 may then be positioned adjacent the surface of component 22. Once the vacuum pad 68 contacts the surface of component 22, a vacuum will be created within vacuum pad 68 causing vacuum pad 68 to flex outwardly as component 22 is pulled against abutment surfaces 27 of alignment rails 26. Alternatively, a respective control button can be pressed prior to positioning vacuum pad 68 adjacent component 22 to flow precise placement and shifting of the aligning and securing apparatus during placement. Once the proper position is obtained, the control button 100 is released creating the necessary vacuum causing the abutment of component 22 and abutment surfaces 27. Component 20 may then be placed in the vertical position as shown in FIG. 1 against vacuum pad 68 and abutment surfaces 27 of the first alignment plate. Again, the vacuum in vacuum pad 68 and the resulting pulling force will hold a component 20 in abutment with abutment surfaces 27 of alignment rails 26. Of course, the respective control button may be pushed to allow component 20 to be moved into a predetermined position relative to component 22, and then released to secure component 20 to first alignment plate 12. The abutment joint 102 formed between components 20 and 22 may then be worked by using a joining process. Of course, some joining processes may require working steps to be performed prior to securing the components such as applying an adhesive to one or both of the components 20, 22 at joint 102. If a different orientation between the alignment plates is desired, the set screws 38 may be loosened to permit pivoting of the plates into the desired angular position. Plates 12 and 14 may be rotated into an infinite number of angular orientations. For example the aligning and securing apparatus can be moved further in the extended position so as to rotate first alignment plate 12 counter clockwise as shown in FIG. 1 and second alignment plate clockwise as shown in FIG. 1 so as to create a 60° angle between components 20 and 22 in the space occupied by the alignment and securing apparatus 10.

FIGS. *7a* and *7b* illustrate an alternative embodiment of the alignment and securing apparatus of the present invention in which first and second alignment plates 110 and 112, respectively, are each formed with an integral hinge portion 114 and 116, respectively. Each hinge portion 114, 116 includes a bore 118 which is positioned in alignment with the bore of the other plate to form an aperture for receiving a hinge pin 120. Each hinge portion 114, 116 also includes a cut-out 122 extending the full width of hinge portion 114, 116 and connected to bore 118. In addition, each hinge portion 114, 116 includes a transverse aperture 124 extending therethrough on both sides of cut-out 122. A fastener positioned in transverse aperture 124 is tightened which tends to close cut-out 122 thus moving the hinge portion into secure abutment against hinge pin 120 so as to lock alignment plates 110 and 112 into a desired angular orientation. Alternatively, a cut-out and transverse aperture may be formed in the respective hinge portion on the opposite side of the bore 118 for securing the plates in a desired position. The plate design of this embodiment is particularly advantageous in minimizing production costs since each alignment plate is identical and, therefore, may be simply and inexpensively formed using a casting or molding process, such as injection molding of a plastic material. Moreover, the hinge arrangement of this embodiment provides a simple and effective manner of adjusting the orientation of the alignment plates.

The alignment and securing apparatus of the present invention is particularly advantageous in minimizing the time and effort required in aligning and securely positioning two or more components relative to one another to permit connection of the components in a precise relative orientation. Conventional clamping techniques require various clamping devices which must be attached to the adjacent edges to two components resulting in substantial set-up time and effort. The alignment and securing apparatus of the present invention can be used to quickly and securely position two components in practically an infinite number of relative orientations. Moreover, the apparatus is compact and can be formed of a light weight plastic making it extremely portable and easy to handle. Also, the vacuum assembly 18 is designed to create a highly compact, unitized aligning and securing apparatus capable of generating extremely high holding forces to prevent relative movement of components to be secured.

INDUSTRIAL APPLICABILITY

The present alignment and securing apparatus may be used to align and securely position practically any two components requiring processing, treating or joining wherein the relative positioning of the components is critical to the satisfactory completion of the process. The alignment and securing apparatus of the present invention is particularly useful in aligning and securing plates and boards to be connected and especially useful in securing plates against relative movement prior to a welding or brazing joining process.

I claim:

1. Apparatus for securely positioning at least two components relative to each another, comprising:

a support frame;

a plurality of alignment plates mounted on said support frame for abutment by the components, said plurality of alignment plates including a first alignment plate and a second alignment plate;

a pivot means connected to said first alignment plate for permitting pivotal movement of said first alignment plate to permit positioning of the components at various angles relative to each other; and a vacuum means connected to at least one of said first and said second alignment plates for holding a respective component against said first alignment plate, wherein said first and said second alignment plates each include an abutment surface for abutting a respective component, said vacuum means including a first flexible vacuum pad mounted on said first alignment plate adjacent said abutment surface and a second flexible vacuum pad mounted on said second alignment plate adjacent said abutment surface, said vacuum means further including a vacuum pump means mounted on at least one of said first alignment plate, said second alignment plate and said support frame, said vacuum pump means including a first vacuum pump mounted on said first alignment plate, a second vacuum pump mounted on said second alignment plate and an air supply means for supplying pressurized air to said first and said second vacuum pumps.

2. The apparatus of claim 1, wherein said first and second alignment plates are capable of being positioned in a single common plane.

3. The apparatus of claim 2, further including a locking means for preventing relative pivotal movement of said first and said second alignment plates by securing said first and said second alignment plates in a predetermined alignment position.

4. The apparatus of claim 1, wherein said pivot means includes a pivot hinge connected to said first and second alignment plates to permit pivotal movement of both said first and said second alignment plates, said pivot hinge forming a common pivot axis for both said first and said second alignment plates.

5. The apparatus of claim 4, wherein each of said first and second alignment plates are capable of pivoting at least approximately 90 degrees around said common pivot axis.

6. The apparatus of claim 1, wherein said vacuum pump means further includes a control valve means mounted on said support frame for controlling the flow of supply air to said first and said second vacuum pumps.

7. Apparatus for securely positioning at least two components relative to each another, comprising:

a support frame;

a plurality of alignment plates mounted on said support frame for abutment by the components, said plurality of alignment plates including a first alignment plate and a second alignment plate;

a pivot means connected to said first alignment plate for permitting pivotal movement of said first alignment plate to permit positioning of the components at various angles relative to each other; and a vacuum means connected to at least one of said first and said second alignment plates for holding a respective component against said first alignment plate, wherein said support frame includes a first pair of elongated support arms pivotally connected at respective first ends to said first alignment plate and a second pair of elongated support arms pivotally connected to said second alignment plate, each support arm of said first pair of support arms being pivotally connected at a second end to one support arm of said second pair of support arms.

8. Apparatus for securely positioning at least two components relative to each another, comprising:

a support frame;

a plurality of alignment plates mounted on said support frame for abutment by the components, said plurality of alignment plates including a first alignment plate and a second alignment plate;

a pivot means connected to said first alignment plate for permitting pivotal movement of said first alignment plate to permit positioning of the components at various angles relative to each other; and a vacuum means connected to at least one of said first and said second alignment plates for holding a respective component against said first alignment plate, wherein pivotal movement of one of said first and said second alignment plates causes pivotal movement of the other of said first and said second alignment plates.

9. An apparatus for aligning and securely positioning at least two components relative to one another in a predetermined aligned position to permit accurate connection of the components, comprising:

a support frame;

a plurality of alignment plates mounted on said support frame including a first alignment plate and a second alignment plate positioned adjacent one another, each of said first and second plates including a first side positioned adjacent the component and a second side formed opposite said first side;

a vacuum means for holding a respective component against said first plate and said second plate, said vacuum means including a first flexible vacuum pad mounted on said first side of said first alignment plate, a second flexible vacuum pad mounted on said first side of said second plate and at least one vacuum pump mounted adjacent said second side on at least one of said first plate and said second plate, wherein said vacuum pump means includes a first vacuum pump mounted on said first alignment plate, a second vacuum pump mounted on said second alignment plate and an air supply means for supplying pressurized air to said first and said second vacuum pumps.

10. The apparatus of claim 9, wherein said vacuum pump means further includes a control valve means for controlling the flow of supply air to said first and said second vacuum pumps.

11. The apparatus of claim 10, wherein said control valve means is mounted on said support frame.

12. The apparatus of claim 11, wherein said first and said second alignment plates each include a plurality of alignment rails extending outwardly from said first side of each of the alignment plates, each of said plurality of alignment rails including an abutment surface for abutment by said component, said first and said second vacuum pads being mounted on said first side between said plurality of alignment rails.

13. The apparatus of claim 11, further including a pivot means connected to said first and said second alignment plates for permitting said first and second alignment plates to pivot relative to one another.

14. The apparatus of claim 13, further including a locking means for preventing relative pivotal movement of said first and said second alignment plates by securing said first and said second alignment plates in a predetermined alignment position.

15. The apparatus of claim 13, wherein pivotal movement of one of said first and said second alignment plates causes pivotal movement of the other of said first and said second alignment plates.

16. The apparatus of claim 9, wherein said support frame includes a first pair of elongated support arms pivotally connected at respective first ends to said first alignment plate and a second pair of elongated support arms pivotally connected to said second alignment plate, each support arm of said first pair of support arms being pivotally connected at a second end to one support arm of said second pair of support arms.

17. An apparatus for aligning and securely positioning at least two components relative to one another in a predetermined aligned position to permit accurate connection of the components, comprising:

a support frame;

a plurality of alignment plates mounted on said support frame including a first alignment plate and a second alignment plate positioned adjacent one another, each of said first and second plates including a first side positioned adjacent the component and a second side formed opposite said first side;

a vacuum means for holding a respective component against said first plate and said second plate, said vacuum means including a first flexible vacuum pad mounted on said first side of said first alignment plate, a second flexible vacuum pad mounted on said first side of said second plate and at least one vacuum pump mounted adjacent said second side on at least one of said first plate and said second plate, wherein said support frame includes a first pair of elongated support arms pivotally connected at respective first ends to said first alignment plate and a second pair of elongated support arms pivotally connected to said second alignment plate, each support arm of said first pair of support arms being pivotally connected at a second end to one support arm of said second pair of support arms.

* * * * *